US006520339B1

(12) United States Patent
Conway, Jr.

(10) Patent No.: US 6,520,339 B1
(45) Date of Patent: Feb. 18, 2003

(54) ARTICLE STORAGE ASSEMBLY WITH AN ATTACHED ARTICLE DISPLAY CASE

(76) Inventor: William F. Conway, Jr., P.O. Box 711, New Albany, IN (US) 47151

( * ) Notice: Subject to any disclaimer, the term of this patent is extended or adjusted under 35 U.S.C. 154(b) by 0 days.

(21) Appl. No.: 09/698,714

(22) Filed: Oct. 27, 2000

(51) Int. Cl.[7] ..... B65D 25/20; B65D 25/54

(52) U.S. Cl. ..... 206/734; 206/730; 312/118

(58) Field of Search ..... 119/248; 206/730–735, 206/769–778; 220/662–665; 229/164; 312/114, 117–121; 426/106

(56) References Cited

U.S. PATENT DOCUMENTS

| | | | | | |
|---|---|---|---|---|---|
| 764,529 | A | * | 7/1904 | Ingalls | 312/118 |
| 799,375 | A | * | 9/1905 | Gray | 206/731 |
| 852,229 | A | * | 4/1907 | Joyce | 312/120 |
| 867,109 | A | * | 9/1907 | Cathrea | 206/730 |
| 1,185,831 | A | * | 6/1916 | Rizzotto | 206/730 |
| 1,455,610 | A | * | 5/1923 | Haskell | 206/734 |
| 1,716,557 | A | * | 6/1929 | Mann | 312/118 |
| 1,838,215 | A | * | 12/1931 | De Clairmont | 119/248 |
| 2,017,962 | A | * | 10/1935 | Fussner | 206/732 |
| 2,037,143 | A | * | 4/1936 | Nutt | 206/733 |
| 2,154,658 | A | * | 4/1939 | Boston | 206/732 |
| 2,606,708 | A | * | 8/1952 | Irvan | 220/796 |
| 3,497,057 | A | * | 2/1970 | Traner et al. | 206/730 |
| 4,047,633 | A | * | 9/1977 | Trombly | 220/665 |
| 5,251,972 | A | * | 10/1993 | Zurawin | 312/114 |
| D446,963 | S | * | 8/2001 | Conway | D6/396 |

* cited by examiner

*Primary Examiner*—Jim Foster
(74) *Attorney, Agent, or Firm*—Maurice L. Miller, Jr.

(57) ABSTRACT

A container for storing a plurality of individually packaged sticks of rock crystal candy for selection and sale to the public and having a transparent plastic case attached to the container and extending across a front surface thereof, which case houses a series of unpackaged sticks of rock crystal candy for viewing by the purchasing public of samples of the packaged sticks stored in the container is disclosed. The case is removably attached to the container so that the samples can be removed and replaced as necessary but cannot be easily entered by members of the public. The display permits grouping of numerous different colors of the stick candy in a single upstanding row and presents the samples in their sparkling and glossy unpackaged form.

19 Claims, 3 Drawing Sheets

ARTICLE STORAGE ASSEMBLY WITH AN ATTACHED ARTICLE DISPLAY CASE

BACKGROUND OF THE INVENTION

This invention relates generally to a container for storing articles for sale, which container includes an attached windowed enclosure for containing samples of the articles stored in the container such that the samples can be readily viewed by prospective purchasers of the stored articles. More specifically, this invention relates to a container for storing individually packaged sticks of rock crystal candy, which container includes an attached windowed enclosure for containing unpackaged samples of the candy sticks stored in the container.

Rock crystal candy formed on a stick is a highly popular hard candy in the present day market, especially among children. Such candy is characterized by a highly sparkling, glossy, crushed crystalline appearance, like glass particles and can be made in a multitude of different colors, as for example, as many as ten or more colors. The aesthetically pleasing and appetizing appearance of such candy sticks is all the more enhanced where candy sticks of all of the various available colors are displayed in a closely arrayed grouping.

A difficulty that has been encountered in the prior art results from the need to individually wrap or package each candy stick intended for sale, for obvious reasons of cleanliness and sanitation, due to the fact that, even when packaged in a clear plastic wrapper, the highly sparkling, glossy, crystalline, glass-like nature of the candy is lost from view and does not show through the transparent wrapper. Indeed, such a clear plastic wrapper has the effect of dulling the true sparkling character of the numerous crystalline granules on the stick , which is otherwise so readily apparent when the stick is removed from its wrapper for consumption.

Accordingly, from a marketing standpoint, it would be desirable if a merchant engaged in selling such rock crystal candy had a convenient means for storing individually packaged sticks of such candy for sale, which container also included means for displaying unpackaged samples of the candy in a secured condition which could be viewed by prospective purchasers in their full range of available colors in their undiminished, sparkling and glossy state. At the same time, the viewable unpackaged candy samples would be separately housed from the packaged candy for sale so that the unpackaged samples could not be easily taken by customers from their housing.

By means of the present invention, these and other difficulties encountered in the prior art are substantially eliminated.

SUMMARY OF THE INVENTION

It is an object of the present invention to provide an article storage assembly having an attached article display case for display of samples of articles stored in the storage assembly.

It is a further object of the present invention to provide a container for storing a plurality of packaged articles having an attached windowed enclosure for housing unpackaged samples of the articles stored in the container for external viewing of the unpackaged samples.

It is yet another object of the present invention to provide a container for storing a plurality of individually packaged sticks of rock crystal candy for selection and sale to the public and a windowed enclosure attached to the container for containing unpackaged samples of candy sticks stored in the container for viewing by the public preparatory to selection and purchase of candy from the container.

Briefly, in accordance with the present invention there is provided an article storage assembly having an article display case including a container for storing a plurality of articles therein and a windowed article display enclosure attached to an outer surface of the container for separately containing at least one sample of the articles to be stored in the container. The enclosure permits external viewing of the samples in the enclosure of the articles stored in the container.

These and other objects, features, and advantages of the present invention will become apparent to those skilled in the art from the following detailed description and attached drawings upon which, by way of example, only a preferred embodiment of my invention is illustrated.

DESCRIPTION OF THE PREFERRED EMBODIMENTS

Figure 2:
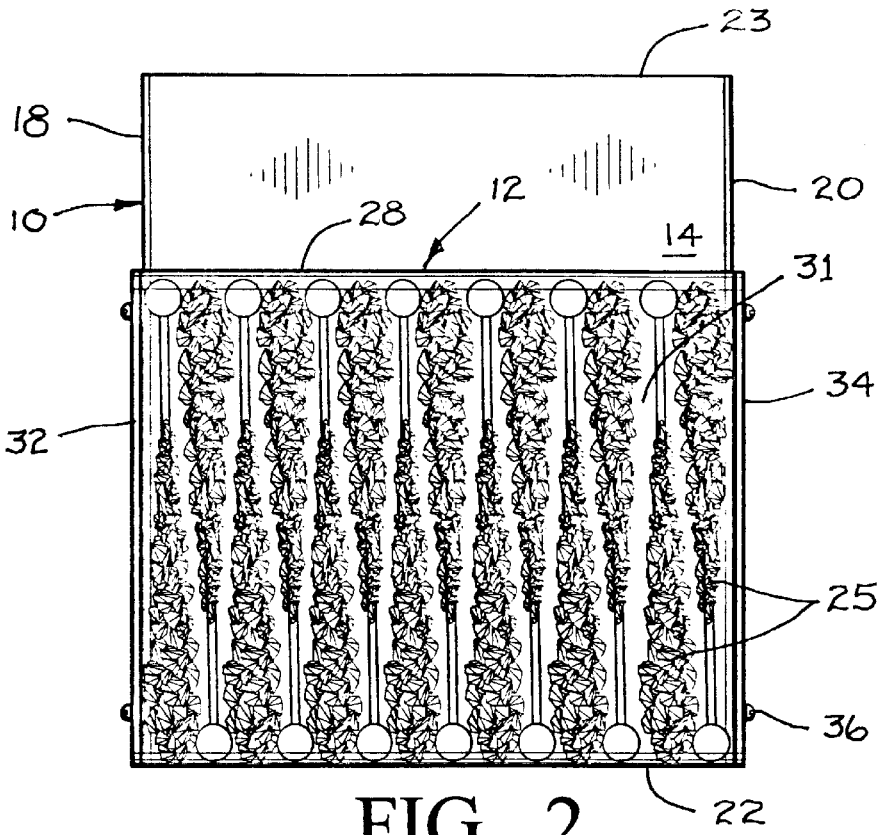
FIG. 2 shows a front elevation view of the assembly and case of FIG. 1.
Figure 3:
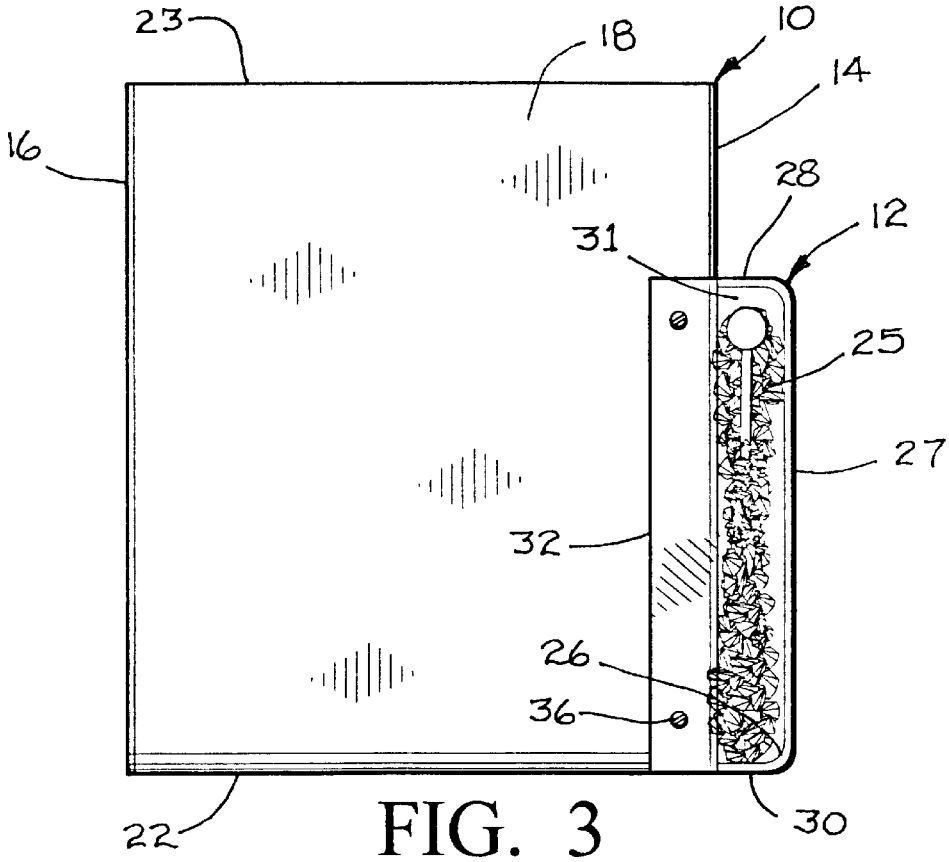
FIG. 3 shows a left side elevation view of the assembly and case of FIGS. 1–2.
Figure 4:
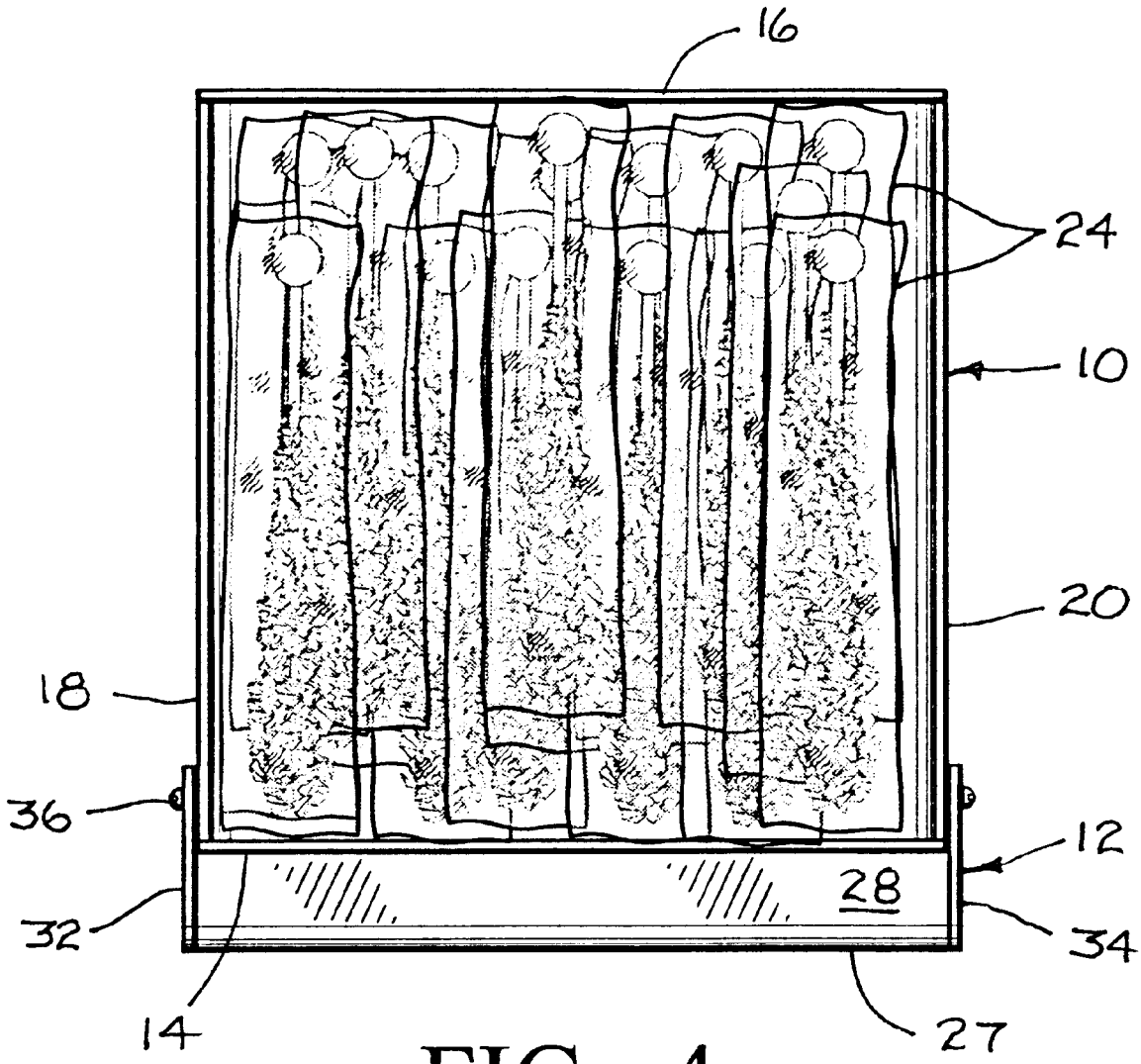
FIG. 4 shows a top plan view of the assembly and case of FIGS. 1–3, with individually packaged rock crystal candy sticks stored in the assembly.

Referring now to the drawing figures, there is shown , in a preferred embodiment of my invention, an article storage container, generally designated 10, having an attached windowed article display enclosure, generally designated 12. The container 10 of the present example is in the form of a rectangularly shaped box having front and rear panels 14 and 16, respectively, opposing side panels 18 and 20, a flat base 22 (See FIGS. 2–3) and an open upper end for disposition and removal of articles 24, such as individually packaged sticks of rock crystal candy (See FIG. 4) into and from the container. The container 10 may be constructed of any suitable material such as wood, sheet metal, or plastic, although, for aesthetic purposes and light weight, I prefer a suitable transparent plastic.

Figure 1:
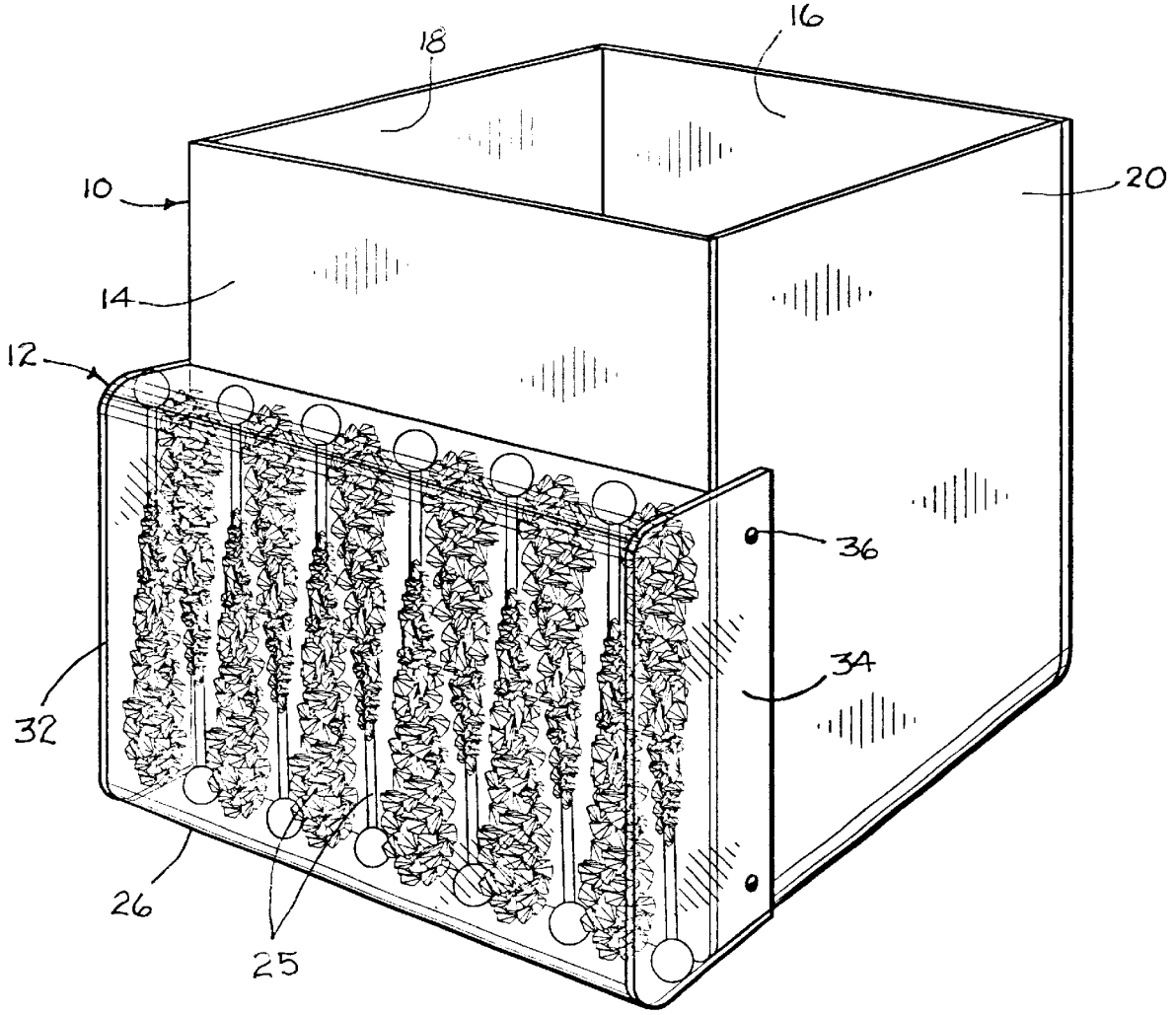
FIG. 1 shows a perspective view of an article storage assembly having an article display case attached thereto containing rock crystal candy on sticks, thus illustrating a preferred embodiment of my invention.

The article display enclosure 12 is adapted to fit across the front panel 14 of the container 10 and should preferably be constructed of a suitable transparent material, such as transparent plastic, for viewing samples 25 of the articles, such as unpackaged sticks of rock crystal candy displayed in the enclosure. In the alternative, the enclosure 12 may be formed of a non-transparent material containing a suitable transparent glass or plastic window. In the present example, the enclosure 12 includes a rectangular shaped, U-shaped plate 26 having a front panel 27 which extends across the front panel 14 of the container 10 and upper and lower flanges 28 and 30, respectively, which flanges space the front panel 27 from the container front panel 14 to form a chamber 31 therebetween in which one or more of the packaged rock crystal candy sticks 25 can be disposed for viewing by the public. The enclosure also includes a pair of side panels 32 and 34 which project rearwardly, as viewed, beyond the chamber 31 thus formed between the front panels 14 and 27 of the container 10 in which the candy sticks 25 are disposed when the enclosure and container are properly joined. The rearwardly projecting portions of the side panels 32 and 34 slidably and closely fit over and against the container side panels 18 and 20 and are secured in a suitable manner to the container side panels as, for example, by means of conventional plastic screws 36. It is desirable that the enclosure 12 attach securely to the container 10,such that members of the public cannot easily remove its contents, yet be removable as necessary to remove and replace the contents of the enclosure. The vertical and horizontal depths of the chamber 31 formed between the panels 14 and 27 should preferably be sufficient to stand a single row of unpackaged sticks of rock crystal candy 25 therein as shown (See particularly FIG. 3). It is also desirable that the width of the chamber 31 from side-to-side be sufficient to store a single row of unpackaged candy sticks 24 in sufficient number to show all available colors of the candy (See particularly FIGS. 1–2). Such a sparkling, multi-colored display of the candy sticks 25, closely grouped as shown, presents a highly pleasing and appetizing display.

The container 10 may be sized as desired for placement on a table, shelf or counter so as to store a suitable number of individually packaged sticks 25 of rock crystal candy (FIG. 4) for sale.

A recommended size for the container 10 and display enclosure 12 of the present example includes a box shaped container open on its upper end and being 10 inches in height by 8¾ inches width by 8¾ inches deep. The attached display enclosure may be 7¼ inches in height, 9 inches wide and 2⅛ inches deep. A container 10 of the suggested size will store about eighty individually packaged crystal candy sticks 6½–6¾ inches in length. A display enclosure 12 of the suggested size will house up to about fourteen unpackaged sticks in a closely spaced upstanding single row for excellent viewing by the prospective purchasers of the stored candy.

Although the present invention has been shown and described with respect to specific details of a certain preferred embodiment of my invention, it is not intended that such details limit the scope and coverage of this patent other than as expressly set forth in the following claims, keeping in mind reasonable equivalent variations thereof.

I claim:

1. An assembly and display case for candy comprising a container having wall structure defining a first storage chamber for storing a plurality of packaged articles of candy;

a means for externally accessing said storage chamber;

at least one packaged article of said candy being disposed in said first chamber; and an at least partially transparent enclosure defining a second chamber separately containing a plurality of unpackaged samples of the candy disposed in said container for permitting external viewing of the samples in said enclosure, said enclosure being attached to said wall structure of said container outside of said storage chamber, said samples being arranged in a row.

2. The assembly and case of claim 1 wherein said container is box shaped and includes a front panel and two side panels, said enclosure being fixedly attached to said side panels and extending across said front panel.

3. The assembly and case of claim 1 wherein said enclosure includes a front face formed of a transparent material.

4. The assembly and case of claim 1 wherein said enclosure is removably attached to said container to permit removal and replacement of said sample as desired.

5. The assembly and case of claim 1 wherein said enclosure is constructed of transparent plastic.

6. The assembly and case of claim 1 further comprising, in combination, a series of unpackaged sticks of rock crystal candy disposed in said second chamber, said second chamber being of a height and depth sufficient to permit said series of candy sticks to stand upright in said row across a front portion of said container.

7. The assembly and case of claim 1 wherein said enclosure is formed of a transparent plastic.

8. The assembly and case of claim 1 wherein said means comprises an open upper end portion of said container.

9. The assembly and case of claim 1 wherein said container is formed in the shape of a rectangular box.

10. The assembly and case of claim 1 wherein said article and said samples of candy comprise rock crystal candy.

11. The assembly and case of claim 1 wherein said article and said samples of candy comprise rock crystal candy formed on a stick.

12. The assembly and case of claim 1 wherein said container includes an open upper end for permitting access to the articles stored in said container.

13. The assembly and case of claim 2 wherein said enclosure comprises a rectangularly shaped, U-shaped plate having a front panel which extends across the front panel of said container and upper and lower flanges which space said front panel of said plate from said front panel of said container to form said second chamber between said front panels in which said samples can be disposed, said enclosure further comprising a pair of side panels on opposite sides of said plate to enclose the sides of said second chamber, said enclosure side panels extending rearwardly next to outer surfaces of forward edge portions of said container side panels, said enclosure side panels being secured to said container side panels.

14. A storage assembly and display case for rock crystal candy comprising a box shaped container having front and rear panels, a pair of side panels and a base, said container being open on an upper end thereof, said container being sized for storing a plurality of sticks of rock crystal candy;

a transparent plastic housing extending across said container front panel and being removably attached to said container side panels, said housing and container front panel forming an enclosure sized for storing in upstanding attitude, a single row containing unpackaged sticks of rock crystal candy for external viewing; and a plurality of unpackaged and upstanding sticks of rock crystal candy being arranged in a single row and being disposed in said enclosure.

15. An article storage assembly having an article display case comprising a container having wall structure defining an open end;

a transparent enclosure attached to said wall structure of said container and positioned outside of said container;

at least one packaged stick of candy contained in said container; and a row of upstanding sticks of candy disposed in said enclosure, said upstanding sticks of candy disposed in said enclosure being unpackaged.

16. The assembly and case of claim 15 wherein said sticks of candy comprise rock crystal candy.

17. An article storage assembly having an article display case comprising a container for storing a plurality of articles therein;

a windowed article display enclosure attached to an outer surface of said container for separately containing at least one sample of the articles to be stored in said container, for permitting external viewing of the sample in said enclosure, said enclosure comprising a U-shaped plate having a front panel which extends across a front panel of said container and upper and lower flanges which space said front panel of said plate from said front panel of said container to form a chamber between said front panels in which said sample can be disposed;

a pair of side panels attached on opposite sides of said plate to enclose the sides of said chamber, said enclosure side panels extending rearwardly next to outer surfaces of forward edge portions of said container side panels, said enclosure side panels being secured to said container side panels; and candy being disposed in said enclosure.

18. An article storage assembly having an article display case comprising a container having wall structure defining a storage chamber;

means for externally accessing said storage chamber;

at least one packaged stick of rock crystal candy disposed in said storage chamber;

an at least partially transparent enclosure attached to said wall structure and positioned outside of said storage chamber for permitting articles disposed in said enclosure to be viewed; and a row of unpackaged and upstanding sticks of rock crystal candy being disposed in said enclosure.

19. An article storage assembly having an article display case comprising a container having structure defining an open end;

a transparent enclosure attached to said wall structure of said container and positioned outside of said container;

at least one packaged stick of candy contained in said container; and a row of upstanding sticks of candy disposed in said enclosure, said upstanding sticks of candy being alternately disposed in said enclosure in an upside down stance and an upright stance.

* * * * *